US012324526B1

(12) United States Patent
Pender et al.

(10) Patent No.: US 12,324,526 B1
(45) Date of Patent: Jun. 10, 2025

(54) BABY SEAT

(71) Applicants: Micaela Pender, Clinton, NJ (US); Stephen Sanford, Bozeman, MT (US); Demri Horton, Bozeman, MT (US)

(72) Inventors: Micaela Pender, Clinton, NJ (US); Stephen Sanford, Bozeman, MT (US); Demri Horton, Bozeman, MT (US)

( * ) Notice: Subject to any disclaimer, the term of this patent is extended or adjusted under 35 U.S.C. 154(b) by 170 days.

(21) Appl. No.: 18/114,590

(22) Filed: Feb. 27, 2023

Related U.S. Application Data

(60) Provisional application No. 63/314,327, filed on Feb. 25, 2022.

(51) Int. Cl.
*A47D 1/10* (2006.01)

(52) U.S. Cl.
CPC ..... *A47D 1/106* (2013.01)

(58) Field of Classification Search
CPC ..... A47D 1/106
USPC ..... 297/174 CS
See application file for complete search history.

(56) References Cited

U.S. PATENT DOCUMENTS 2,710,643 A * 6/1955 Wincey ..... A47D 1/106 248/231.71
5,480,211 A * 1/1996 Douglas ..... A47D 1/106 297/335
6,273,503 B1 * 8/2001 Cheng ..... A47D 1/106 297/219.12
6,736,451 B1 * 5/2004 Chen ..... A47D 1/106 297/251

* cited by examiner

*Primary Examiner* — Milton Nelson, Jr.
(74) *Attorney, Agent, or Firm* — QuickPatents; Kevin Prince

(57) ABSTRACT

A baby seat for attaching to a table includes a U-shaped support frame that has two opposing arms, each that is connected with a lower support surface. A flexible seat is adapted for fixing at least partially over the U-shaped support frame and being suspended thereby. The flexible seat includes a U-shaped cover, a seat bottom, and a front cover that has two leg apertures therethrough. A clamping mechanism is fixed with each of the two opposing arms of the U-shaped support frame and includes a lower clamping arm having a top surface adapted for contacting the bottom surface of the table. The clamping mechanism may further include a lever arrangement and an actuator arm that projects rearwardly away from the front cover of the flexible seat. The actuator arm is movable between an open position and a clamped position.

13 Claims, 5 Drawing Sheets

BABY SEAT

CROSS-REFERENCE TO RELATED APPLICATIONS

This application claims the benefit of U.S. Provisional Patent Application 63/314,327, filed on Feb. 25, 2022, and is incorporated herein by reference.

STATEMENT REGARDING FEDERALLY SPONSORED RESEARCH AND DEVELOPMENT

Not Applicable.

FIELD OF THE INVENTION

This invention relates to baby seats, and more particularly to a table-attachable baby seat.

BACKGROUND

Baby chairs for attaching to the side edge of a table or counter are known in the prior art, but are notoriously complex and difficult to use. Further, such prior art baby chairs are often difficult to clean due to use of fabrics, and are not easily collapsed for travel or storage.

Therefore, there is a need for a device that is easily expanded and attached to the edge of a table that securely seats a baby. The present invention would be relatively simple and intuitive to use. Such a needed device would be easily collapsed for storage or transport, and would include a relatively easy-to-clean material for a collapsible seat. The present invention accomplishes these objectives.

SUMMARY OF THE INVENTION

The present device is a baby seat for attaching to a table that has a top surface, a side edge, and a bottom surface. The word "table" herein is broadly defined as any suitably rigid surface, such as a countertop, desk, or other support structure, which has the side edge, the top surface, and the bottom surface.

The baby seat includes a U-shaped support frame that has two opposing arms, each that is connected with a lower support surface that is itself adapted for contacting the top surface of the table. The lower support surface may be formed as part of the U-shaped support frame, or may include a separate piece that is connected with one of the arms of the U-shaped support frame, typically with a mechanical fastener or simply a friction-fit.

A flexible seat is adapted for fixing at least partially over the U-shaped support frame and being suspended thereby. The flexible seat includes a U-shaped cover, a seat bottom, and a front cover that has two leg apertures therethrough. The flexible seat, when suspended from the U-shaped support frame, assumes an expanded configuration. When compressed the flexible seat assumes a collapsed configuration, a useful configuration for storage and transport of the baby seat.

A clamping mechanism is fixed with each of the two opposing arms of the U-shaped support frame and includes a lower clamping arm having a top surface adapted for contacting the bottom surface of the table. The clamping mechanism may further include a lever arrangement and an actuator arm that projects rearwardly away from the front cover of the flexible seat. The actuator arm is movable between an open position and a clamped position. Preferably each actuator arm is mutually connected to form a U-shaped actuator arm.

As such, with each actuator arm of the clamping mechanisms in the open position, and with the lower support surface of each arm of the U-shaped support frame resting on the top surface of the table proximate the side edge of the table, and with the top surface of the lower clamping arm below the bottom surface of the table, each actuator arm of the clamping mechanisms can be moved to the clamped position to clamp the table between the lower support surface of each arm and the top surfaces of the lower clamping arms.

The present invention is a device that is easily expanded and attached to the edge of a table and that securely seats a baby. The present invention is relatively simple with few moving parts, making it relatively inexpensive to manufacture and intuitive to use. The present device is easily collapsed for storage or transport, and provides a relatively easy-to-clean material for the collapsible seat. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1A:
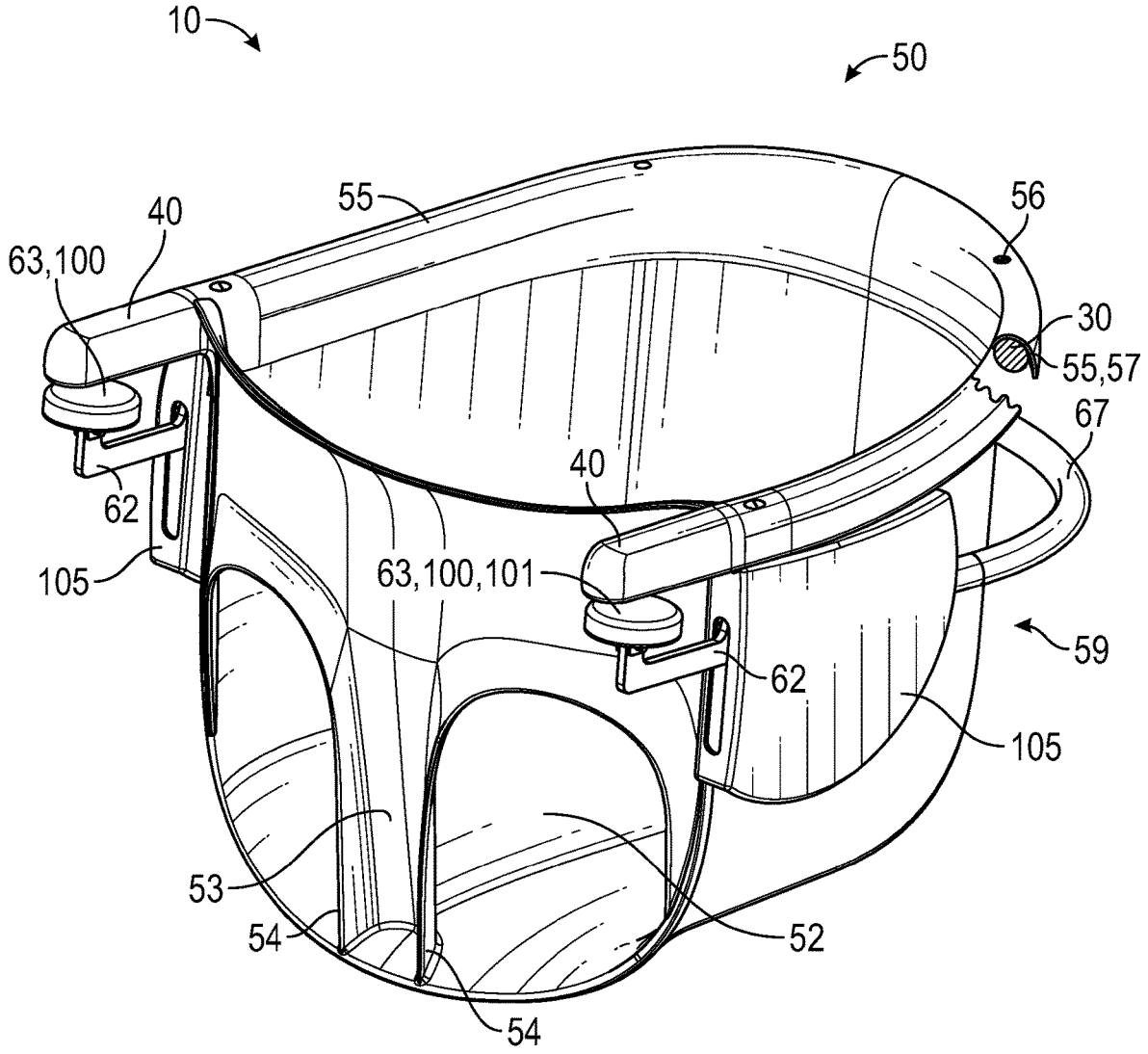
FIG. 1A is perspective view of the invention, illustrated with a flexible seat in an expanded configuration and a clamping mechanism in a clamped position.
Figure 1B:
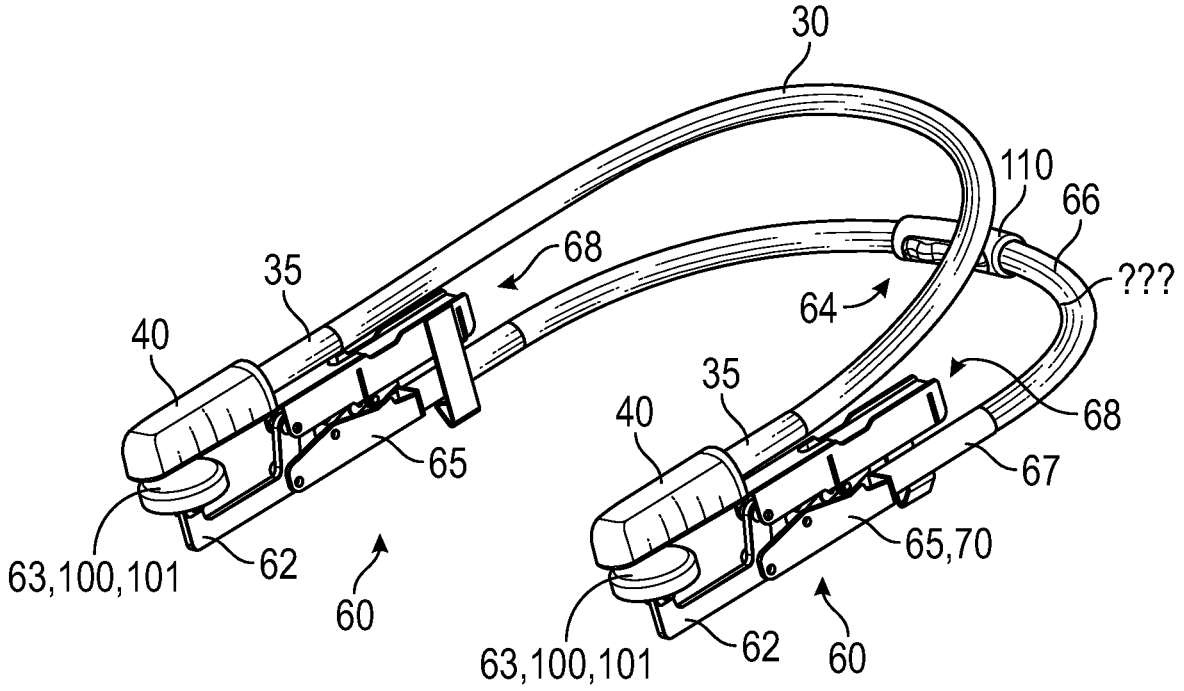
FIG. 1B is a perspective view thereof, illustrated with the flexible seat omitted for clarity of illustration.
Figure 2:
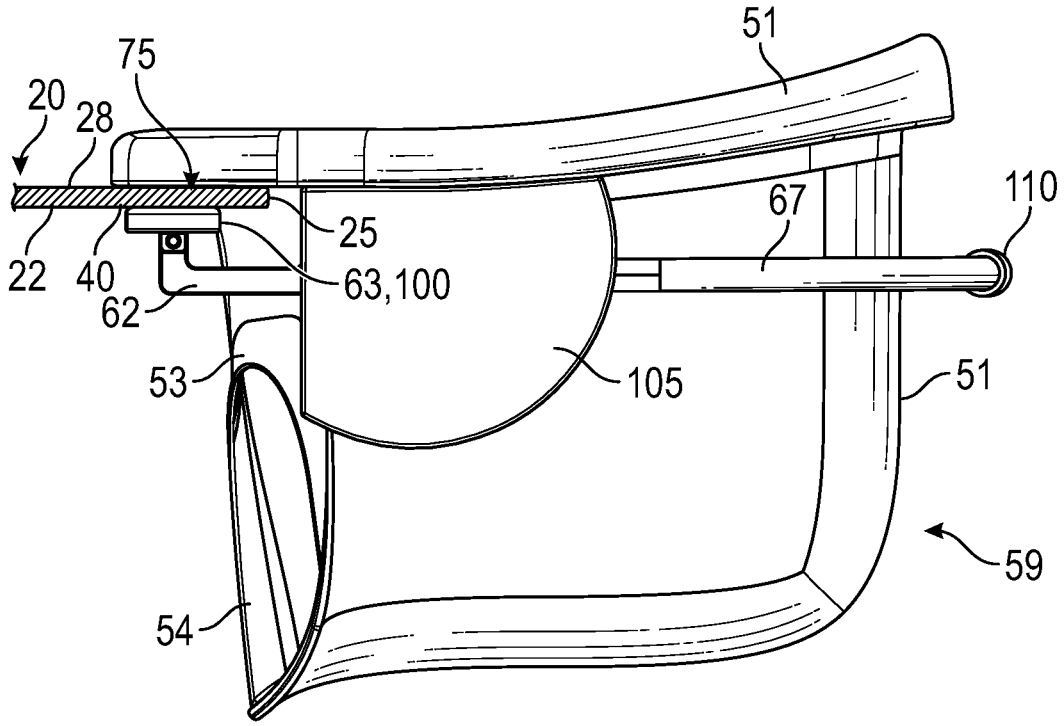
FIG. 2 is a side elevational view of FIG. 1, illustrated as in-use and clamped to a table edge.

FIGS. 1A, 1B and 2 illustrate a baby seat 10 for attaching to a table 20 that has a top surface 28, a side edge 25, and a bottom surface 22. The word "table" herein is broadly defined as any suitably rigid surface, such as a countertop, desk, or other support structure, that has the side edge 25, the top surface 28, and the bottom surface 22.

The baby seat 10 includes a U-shaped support frame 30 (FIG. 1B) that has two opposing arms 35, each that is connected with a lower support surface 40 that is itself adapted for contacting the top surface 28 of the table 20. The lower support surface 40 may be formed as part of the U-shaped support frame 30 (not shown), or may include a separate piece that is connected with one of the arms 35 of the U-shaped support frame 30, typically with a mechanical fastener or simply a friction-fit. Such a lower support surface 40 is made from a rigid, strong material, such as plastic, metal, wood, or the like, and may include a resilient material that is preferably an elastomeric or rubber material where contacting the top surface 28 of the table 20. The U-shaped support frame 30 is preferably made with metallic tubes or other suitably rigid materials.

Figure 4:
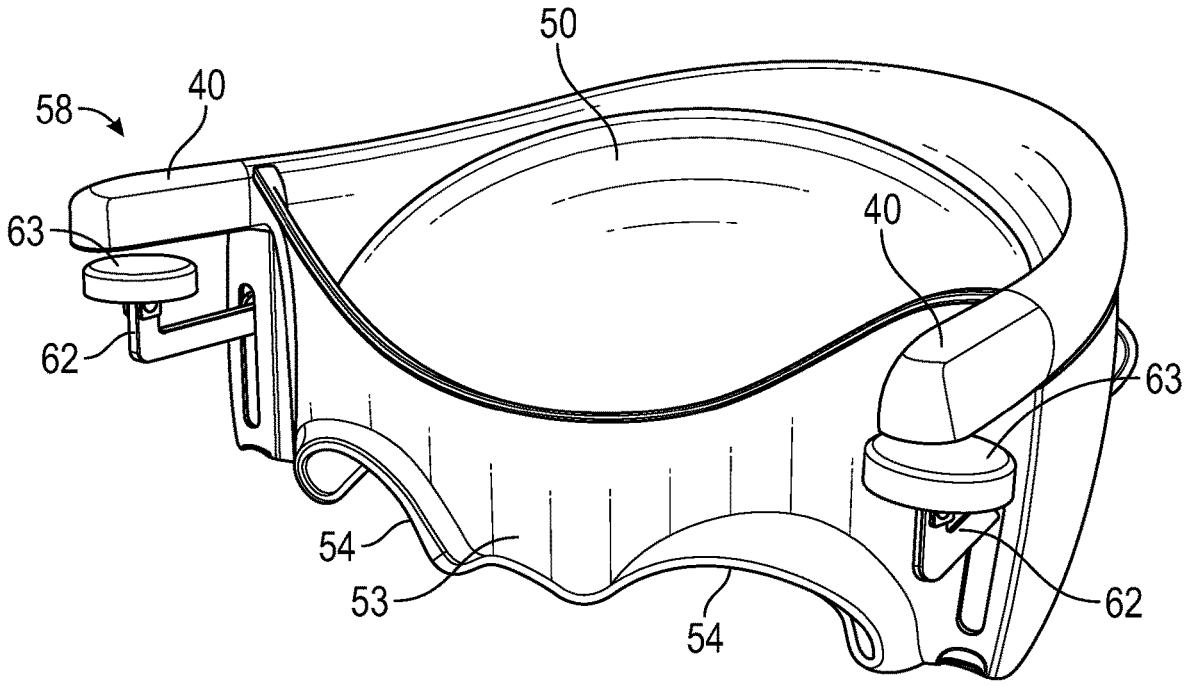
FIG. 4 is a perspective view of the invention, illustrated in a collapsed configuration.

A flexible seat 50 is adapted for fixing at least partially over the U-shaped support frame and being suspended thereby. The flexible seat 50 includes a U-shaped cover 51, a seat bottom 52, and a front cover 53 that has two leg apertures 54 therethrough. The flexible seat 50, when suspended from the U-shaped support frame 30, assumes an expanded configuration 59 (FIGS. 1A and 2). When compressed the flexible seat 50 assumes a collapsed configuration 58 (FIG. 4), a useful configuration for storage and transport of the baby seat 10. A U-shaped channel 55 at a top portion 57 of the flexible seat 50 is adapted for friction fitting around the Us-shaped support frame (FIG. 1A). Alternately, or additionally, the flexible seat 50 is fixed with the U-shaped support frame 30 with mechanical fasteners 56. The flexible seat 50 is preferably made with an easy-to-clean flexible silicon rubber material.

Figure 5:
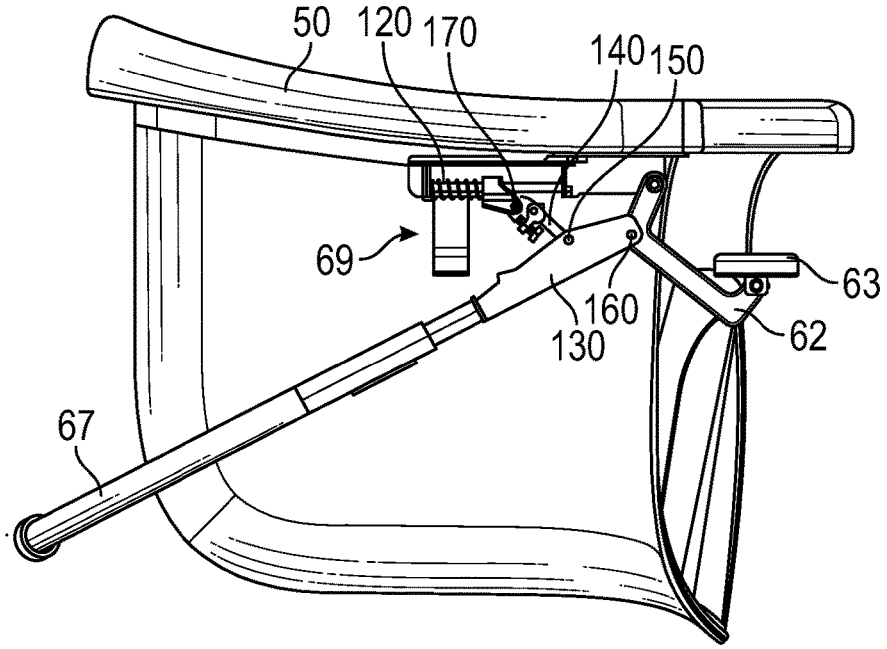
FIG. 5 is a side elevational view of the invention, illustrated with a clamping mechanism in an open position.

A clamping mechanism 60 is fixed with each of the two opposing arms 35 of the U-shaped support frame 30. The clamping mechanism 60 includes a lower clamping arm having a top surface 63 adapted for contacting the bottom surface 22 of the table 20. Such a top surface 63 may include a resilient material 100 that is preferably an elastomeric or rubber material 101. The clamping mechanism 60 may further include a lever arrangement 65 and an actuator arm 67 that projects rearwardly away from the front cover 53 of the flexible seat 50. The actuator arm 67 is movable between an open position 69 (FIG. 5) and a clamped position 68 (FIG. 2). Preferably each actuator arm 67 is mutually connected to form a U-shaped actuator arm 66 (FIG. 1B). In such an embodiment, the U-shaped actuator arm 66 preferably includes an elastomeric grip 110 at an apex 64 of the U-shaped actuator arm 66.

As such, with each actuator arm 67 of the clamping mechanisms 60 in the open position 69, and with the lower support surface 40 of each arm 35 of the U-shaped support frame resting on the top surface 28 of the table 20 proximate the side edge 25 of the table 20, and with the top surface 63 of the lower clamping arm 62 below the bottom surface 22 of the table 20, each actuator arm 67 of the clamping mechanisms 60 can be moved to the clamped position 68 to clamp the table 20 between the lower support surface 40 of each arm 35 and the top surfaces 63 of the lower clamping arms 62.

The clamping mechanism 60 may include a clamping force adjustment mechanism 70 such that a clamping force across a gap 75 formed between the lower support surface 40 of each arm 35 of the U-shaped support frame 30, and the top surface 63 of the lower clamping arm 62, when the actuator arm 67 is moved from the open position 69 towards the clamped position 68, is selectively and manually adjustable. Alternately the clamping mechanism 60 automatically adjusts to provide an adequate clamping force to the table 20, even with a wide variety of table thicknesses.

Figure 3:
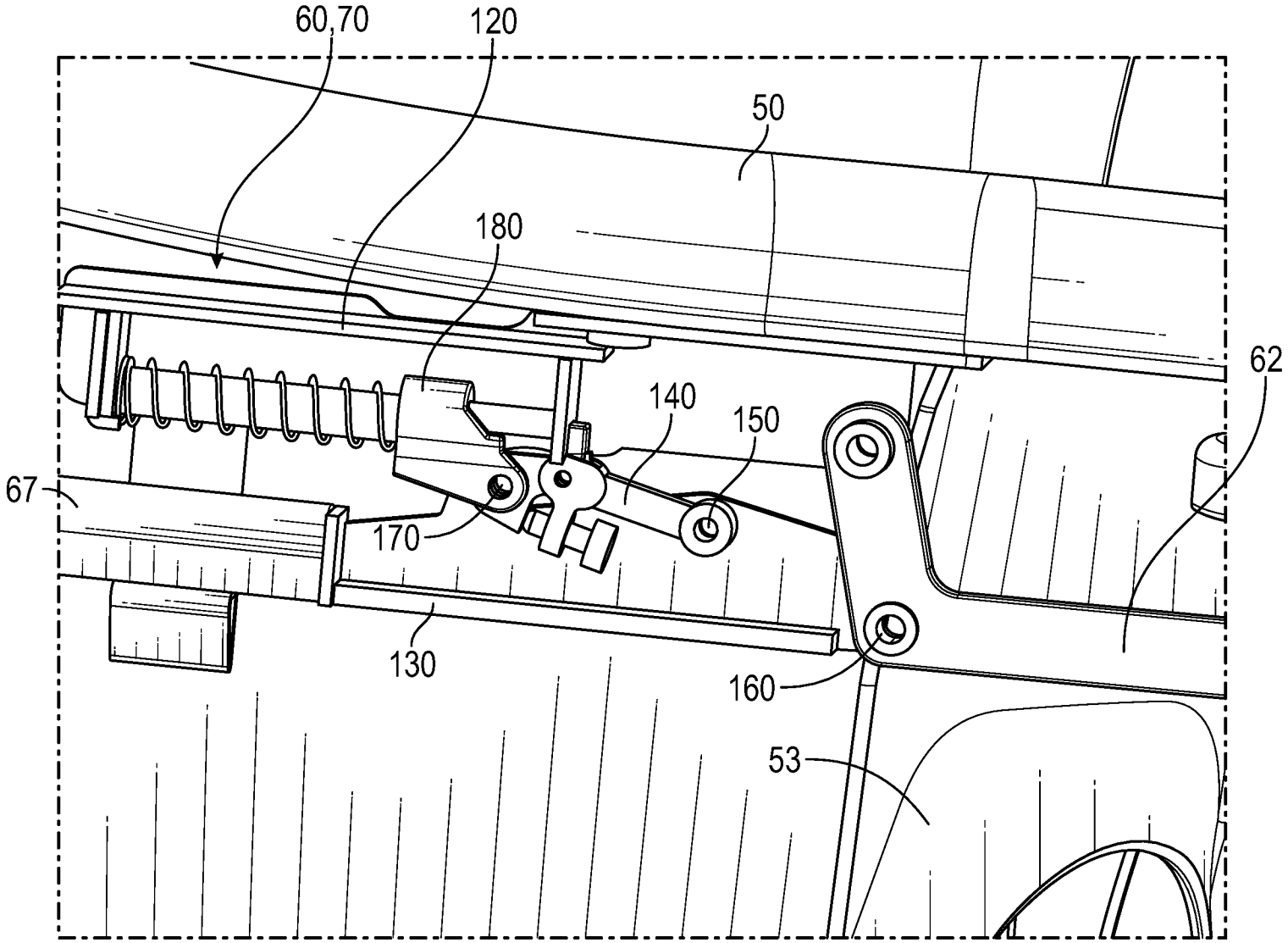
FIG. 3 is an enlarged perspective view of the clamping mechanism.

In one such embodiment, the lever arrangement 65 of each clamping mechanism 60 further includes a clamping base 120 (FIG. 3) fixed with one of the arms 35 of the U-shaped support frame 30. An actuator arm receiver 130 receives the actuator arm 67 and is pivotally attached with the base 120 through a linkage 140 at a first pivot point 150. The actuator arm receiver 130 is also pivotally attached with the lower clamping arm 62 at a second pivot point 160, and with a spring-biased tensioner 180 at a third pivot point 170. As the actuator arm 67 is moved into the open position 69, the linkage 140 is pulled away from the clamping base 120 until the spring-biased tensioner 180 further pushes the linkage 140 away from the clamping base 120. This allows the lower clamping arm 62 to pivot away from the table 20. Conversely, when the actuator arm 67 is moved towards the clamped position 68, the lower clamping arm 62 stops pivoting when the top surface 63 thereof contacts the bottom surface 22 of the table 20. The linkage 140 thereafter is pressed upward toward the clamping base 120 by the actuator arm receiver 130, pressing against the spring-biased tensioner 180 until it passes directly between the first pivot point 150 and the third pivot point 170. Thereafter the spring-biased tensioner 180 pushes against the linkage 140 to maintain it against the clamping base 120. The clamping mechanism 60 firmly holds the baby seat 10 to the table 20 between the top surface 63 of the lower clamping arm 62, and the lower support surface 40 of each arm 35 of the U-shaped support frame 30.

Preferably the actuator arm 67 includes a lever lock 190 (FIG. 1B) that prevents the actuator arm 67 from moving to the open position 69 from the clamped position 68 unless actuated. Such a lever lock 190 may have a lock linkage (not shown) internal to the U-shaped actuator arm 66 that locks the clamping mechanism 60 in place unless withdrawn by actuating the lever lock 190. Alternately, manual catches 195 may be included that prevent the actuator arm 67 from moving to the open position 69 from the clamped position 68 unless the manual catches 195 are manually pressed out of the way.

Figure 6:
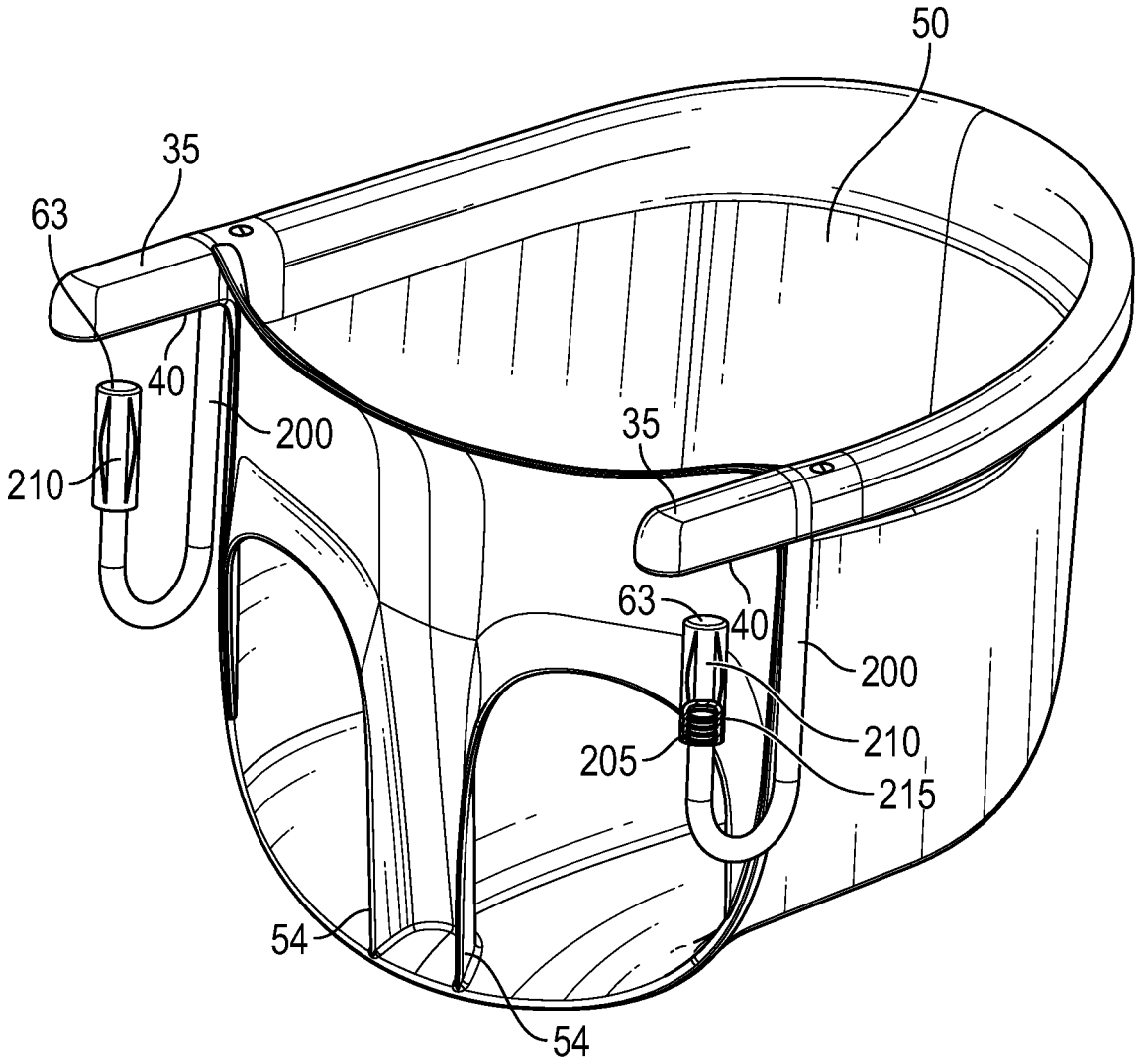
FIG. 6 is a perspective view, partially cut-away, illustrating an alternate embodiment of the clamping mechanism.

In a simplified embodiment of the invention, illustrated in FIG. 6, the lower clamping arm 62 includes a J-shaped arm 200 terminating at an adjustable barrel 210 having the top surface 63, the adjustable barrel 210 having an internal screw thread 215 cooperative with an outer thread 205 of the J-shaped arm 200, whereby the adjustable barrel 210 can be turned until the top surface 63 contacts the bottom surface 22 of the table 20.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention. Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A baby seat for attaching to a table having a top surface, a side edge, and a bottom surface, the baby seat comprising:

a U-shaped support frame having two opposing arms, each arm connected with a lower support surface adapted for contacting the top surface of the table;

a flexible seat adapted for fixing partially over the U-shaped support frame and being suspended thereby, the flexible seat including both a U-shaped cover with a seat bottom, and a front cover having two leg apertures therethrough, the flexible seat when suspended from the U-shaped support frame assuming an expanded configuration, and when compressed assuming a collapsed configuration;

two clamping mechanisms fixed one each with the two opposing arms of the U-shaped support frame, each clamping mechanism including a lower clamping arm having a top surface adapted for contacting the bottom surface of the table;

wherein each clamping mechanism includes a lever arrangement and an actuator arm projecting rearwardly away from the front cover of the flexible seat, the actuator arm of each clamping mechanism moveable between an open position and a clamping position, whereby with the actuator arm of each clamping mechanism in the open position, and with the lower support surface of each arm of the U-shaped support frame resting on the top surface of the table proximate the side edge of the table, and with the top surface of the lower clamping arm below the bottom surface of the table, the actuator arm of each clamping mechanism can be moved to the clamping position to clamp the table between the lower support surface of each arm and the top surface of the lower clamping arms;

whereby with the lower support surface of each arm of the U-shaped support frame resting on the top surface of the table proximate the side edge of the table, the top surface of the lower clamping arm can be brought into contact with the bottom surface of the table to clamp the table between the lower support surface of each arm and the top surface of the lower clamping arms.

2. The baby seat of claim 1 wherein each clamping mechanism includes a protective cover fixed therewith.

3. The baby seat of claim 1 wherein the lever arrangement of each clamping mechanism further includes a clamping base fixed with one of the arms of the U-shaped support frame, and an actuator arm receiver pivotally attached with the base through a linkage at a first pivot point, with the lower clamping arm at a second pivot point, and with a spring-biased tensioner at a third pivot point, whereby as the actuator arm is moved into the open position, the linkage is pulled away from the base until the spring-biased tensioner further pushes the linkage away from the base, allowing the lower clamping arm to pivot away from the table, and conversely when the actuator arm is moved towards the clamping position the lower clamping arm stops pivoting when the top surface thereof contacts the bottom surface of the table, the linkage thereafter being pressed upward toward the base by the actuator arm receiver, pressing against the spring-biased tensioner until it passes directly between the first and third pivot points, thereafter the spring-biased tensioner pushing against the linkage to maintain it against the clamping base, the clamping mechanism firmly holding the baby seat to the table between the top surface of the lower clamping arm and the lower support surface of each arm of the U-shaped support frame.

4. The baby seat of claim 1 wherein each clamping mechanism includes a clamping force adjustment mechanism such that a clamping force across a gap formed between the lower support surface of each arm of the U-shaped support frame and the top surface of the lower clamping arm when the actuator arm is moved from the open position to the clamping position is selectively manually adjustable.

5. The baby seat of claim 1 wherein the lower support surface of each arm of the U-shaped support frame is integrally formed with the U-shaped support frame.

6. The baby seat of claim 1 wherein the lower support surface of each arm of the U-shaped support frame is attached with the U-shaped support frame.

7. The baby seat of claim 1 wherein the flexible seat includes a U-shaped channel at a top portion of the flexible seat adapted for friction fitting around the U-shaped support frame.

8. The baby seat of claim 7 wherein the flexible seat is fixed with the U-shaped support frame with mechanical fasteners.

9. The baby seat of claim 1 wherein the lower support surface of each arm of the U-shaped support frame and the top surface of each lower clamping arm each including a resilient material.

10. The baby seat of claim 9 wherein the resilient material is an elastomeric material.

11. The baby seat of claim 1 wherein the actuator arm of each clamping mechanism is mutually connected to form a U-shaped actuator arm.

12. The baby seat of claim 11 wherein the U-shaped actuator arm includes an elastomeric grip at an apex thereof.

13. A baby seat for attaching to a table having a top surface, a side edge, and a bottom surface, the baby seat comprising:

a U-shaped support frame having two opposing arms, each arm connected with a lower support surface adapted for contacting the top surface of the table, the lower support surface of each arm of the U-shaped support frame being attached with the U-shaped support frame, the actuator arm of each clamping mechanism being mutually connected to form a U-shaped actuator arm;

a flexible seat adapted for fixing partially over the U-shaped support frame and being suspended thereby, the flexible seat including both a U-shaped cover with a seat bottom, and a front cover having two leg apertures therethrough, the flexible seat when suspended from the U-shaped support frame assuming an expanded configuration, and when compressed assuming a collapsed configuration, the flexible seat including a U-shaped channel at a top portion of the flexible seat adapted for friction fitting around the U-shaped support frame;

two clamping mechanisms fixed one each with the two opposing arms of the U-shaped support frame, each clamping mechanism including a lower clamping arm having a top surface adapted for contacting the bottom surface of the table, a lever arrangement, and an actuator arm projecting rearwardly away from the front cover of the flexible seat, the actuator arm moveable between an open position and a clamping position, each clamping mechanism including a plastic cover fixed therewith;

the lower support surface of each arm of the U-shaped support frame and the top surface of each lower clamping arm each including a resilient, elastomeric material;

wherein the lever arrangement of each clamping mechanism further includes a clamping base fixed with one of the arms of the U-shaped support frame, and an actuator arm receiver pivotally attached with the base through a linkage at a first pivot point, with the lower clamping arm at a second pivot point, and with a spring-biased tensioner at a third pivot point, whereby as the actuator arm is moved into the open position, the linkage is pulled away from the base until the spring-biased tensioner further pushes the linkage away from the base, allowing the lower clamping arm to pivot away from the table, and conversely when the actuator arm is moved towards the clamping position the lower clamping arm stops pivoting when the top surface thereof contacts the bottom surface of the table, the linkage thereafter being pressed upward toward the base by the actuator arm receiver, pressing against the spring-biased tensioner until it passes directly between the first and third pivot points, thereafter the spring-biased tensioner pushing against the linkage to maintain it against the clamping base, the clamping mechanism firmly holding the baby seat to the table between the top surface of the lower clamping arm and the lower support surface of each arm of the U-shaped support frame;

whereby with each actuator arm of the clamping mechanisms in the open position, and with the lower support surface of each arm of the U-shaped support frame resting on the top surface of the table proximate the side edge of the table, and with the top surface of the lower clamping arm below the bottom surface of the table, each actuator arm of the clamping mechanisms can be moved to the clamping position to clamp the table between the lower support surface of each arm and the top surface of the lower clamping arms.

* * * * *